US006629402B1

(12) United States Patent
Zawalick

(10) Patent No.: US 6,629,402 B1
(45) **Date of Patent: *Oct. 7, 2003**

(54) METHOD FOR PRESERVING AN OXYGEN SENSITIVE LIQUID PRODUCT

(76) Inventor: Steven Scott Zawalick, P.O. Box 13838, San Luis Obispo, CA (US) 93406

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/267,149

(22) Filed: Mar. 11, 1999

Related U.S. Application Data

(60) Provisional application No. 60/078,492, filed on Mar. 18, 1998.

(51) Int. Cl.[7] ..... B65B 31/02
(52) U.S. Cl. ..... 53/432; 53/403
(58) Field of Search ..... 53/403, 432

(56) References Cited

U.S. PATENT DOCUMENTS 3,677,477 A * 7/1972 Watson et al. ..... 241/31
3,878,664 A * 4/1975 Zinke ..... 53/22 R
4,049,158 A * 9/1977 Lo et al. ..... 222/95
4,425,246 A * 1/1984 Holzwarth et al. .... 252/8.55 D
4,934,127 A * 6/1990 Risko et al. ..... 53/511
5,060,823 A * 10/1991 Perlman ..... 222/1
5,452,563 A * 9/1995 Marano et al. ..... 53/432
5,673,731 A * 10/1997 Green et al. ..... 141/18
5,682,723 A * 11/1997 Nowotarski et al. ..... 53/403
5,704,473 A * 1/1998 Oster ..... 206/314
5,885,640 A * 3/1999 Andersson ..... 426/316
6,007,727 A * 12/1999 Bohrer et al. ..... 210/759
6,077,605 A * 6/2000 McGowan et al. ..... 428/389
6,098,843 A * 8/2000 Soberanis et al. ..... 222/53
6,146,610 A * 11/2000 Gunkel ..... 423/322

* cited by examiner

*Primary Examiner*—Eugene Kim
*Assistant Examiner*—Christopher Harmon

(57) ABSTRACT

A method or process for substituting an inert gas or blend of inert gases for ambient air in the head space of a container filled with leftover oil-based finish prior to sealing the lid. Even a tightly sealed container of leftover paint, stain, varnish, or other oil-based finish, will thicken, gel, or skin over with time. This occurs because the oxygen that is sealed in the storage container continues to react with oil-based finishes. The process involves using an aerosol can filled with the inert gas or blend of gases to displace the oxygen from a container that has leftover oil-based finish in it. After the oxygen is flushed out of a container with the gas, the lid is sealed tightly. The inert gas or blend must be heavier than oxygen and sink down to block oxygen from the liquid surface. Because gas or blend is heavier than oxygen, it will separate the liquid surface from any oxygen that may remain in a container. The blanket of non-reactive, protective gas used to purge the container allows safe and economical storage of finish.

7 Claims, 3 Drawing Sheets

METHOD FOR PRESERVING AN OXYGEN SENSITIVE LIQUID PRODUCT

This application is based on provisional application Ser. No. 60/078,492, filed Mar. 18, 1998.

FIELD OF THE INVENTION

This invention relates to a process or method for removing an oxygen-containing gas from the head space of a container partially filled with a liquid product typically cured by an oxygen-containing gas. Specifically, it relates to a process for substituting a gas or blend of gases for atmospheric air (which contains approximately 21% oxygen) in the head space of a container to prevent an oil-based product or finish (e.g., paint, stain, varnish, polyurethane, and the like) from curing (i.e., hardening, gelling, skinning over, etc.) with oxygen.

BACKGROUND OF THE INVENTION

Even a tightly sealed container filled with leftover paint, stain, varnish, or other oil-based finish, will thicken, gel, or skin over with time. This occurs because the oxygen that is sealed in the storage container continues to react with oil-based finishes. When these finishes are stored, enough oxygen can be trapped inside the container to cure and thicken the product, eventually forming a skin over the top. The thickening of the product during storage ultimately degrades the product and its original chemical composition.

Historically, there are several non-patented prior attempts to eliminate the head space in a container filled with left over oil-based finish. Some inventors have tried to eliminate the air space in a container filled with left-over oil-based finish by placing marbles or rocks in the liquid. This is thought to "fill" up the container and eliminate the head space. In addition to contaminating the oil-based finish, the cleaning of the marbles results in lots of wasted time and product. Another prior attempt was to transfer the liquid to a smaller container to reduce the air space, but this often resulted in inventory tracking and contamination problems. Since the labeling was on the original container, tracking the instruction labels and warnings was also a problem. Yet another prior attempt is to try to store the leftovers upside down which would only guarantee that the skin will form on the "bottom" of the liquid. The leftover oil-based finish will still be ruined. Finally, attempts were made to physically exhale into a container before it is sealed. However, the air we exhale is not oxygen free (in fact, it will support life). We inhale 21% oxygen and exhale approximately 15% oxygen. Therefore, this attempt fails to protect the leftover finish.

Hayashi, et al., U.S. Pat. No. 4,602,473; Mizandjian, et al., U.S. Pat. No. 4,870,801; and Marano, et al. U.S. Pat. No. 5,452,563 are directed to inert gas preservation in other industries such as food. These prior art examples are directed to a different problem than the one solved by this invention. In the food industry, oxygen promotes bacteriological growth and furthers the decay of perishable goods. In contrast, the method of the present invention isolates a chemical necessary for the curing of non-food liquid products such as a finish resin that is cured by an oxygen-containing gas.

The process and method described here for displacing oxygen from the head space of a container filled with oil-based finish is based on proven technology.

BRIEF SUMMARY OF THE INVENTION

The present invention provides a method or process for preserving a non-food liquid product during storage. The method consists of displacing air or other oxygen-containing gas from the head space of a container containing the non-food liquid product such as an oil-based product using an inert gas or a blend of inert gases and sealing the container after the oxygen has been displaced. The inert gas or blend of inert gases used must be heavier than oxygen.

The process of preserving oil-based products during storage by use of an inert gas or a blend of inert gases that is heavier than oxygen has many advantages over prior attempts in that:

(1) It saves money by allowing consumers to use 100% of their oil-based products. No product is wasted and, thus also reduces the amount of hazardous waste and preserves our environment and resources.

(2) It is a simple and smart process for flushing oxygen from the head space of a container. Time will be saved when starting the next finishing job since there is no skin to clean off the top of the finish, the finish will not have to be filtered, and the original finish chemistry is ensured.

(3) It will compliment other tools used in the trade, such as spray guns or paint brushes. Spray guns will no longer get clogged and brushes will maintain their functional use. This allows work to be performed faster and more reliably.

(4) It will prevent changes in product chemistry during storage. This allows for higher quality consistency and repeatability in finishing jobs.

(5) By using an inert gas or a blend of inert gases that is heavier than oxygen to purge oxygen from containers filled with oil-based finishing product, a long term deficiency has been corrected with a simple, smart chemical remedy.

BRIEF DESCRIPTION OF THE DRAWINGS

The preferred embodiment of the invention will now be described in detail with reference to the drawings, wherein.

Figure 1:
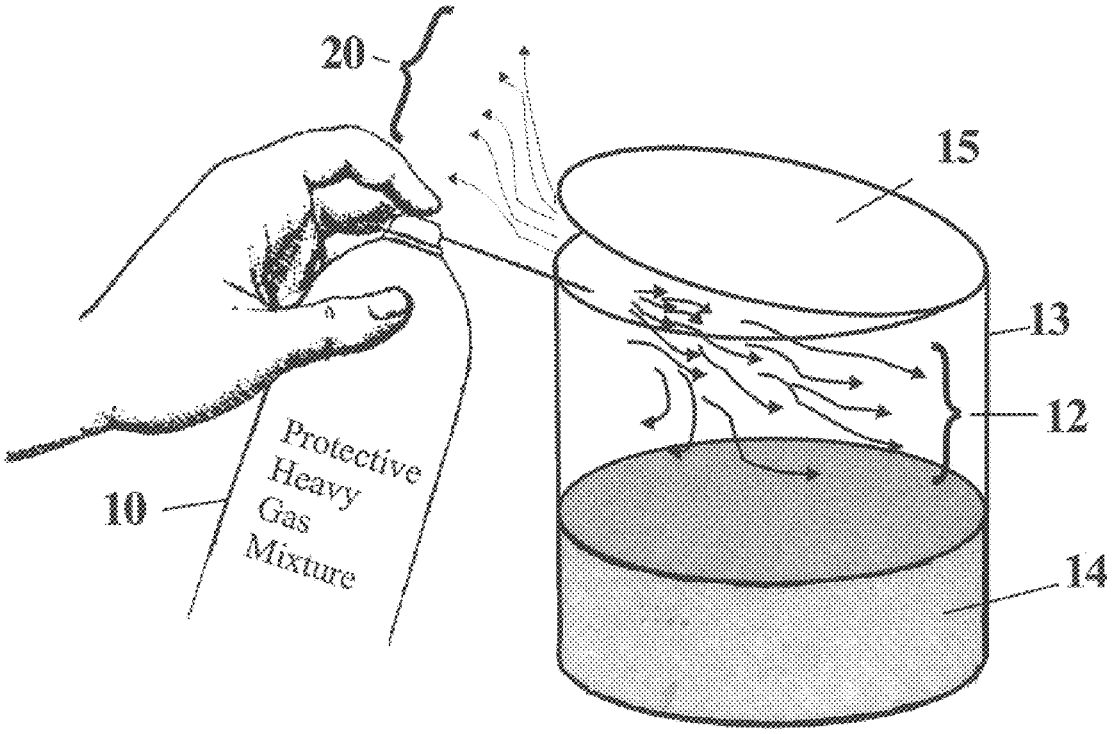
FIG. 1 shows the process in which to use an aerosol can filled with an inert gas or a blend of inert gases to displace the oxygen from a container that has leftover finish in it. After the oxygen is flushed out of a container with the gas or blend, then the lid is sealed.
Figure 2:
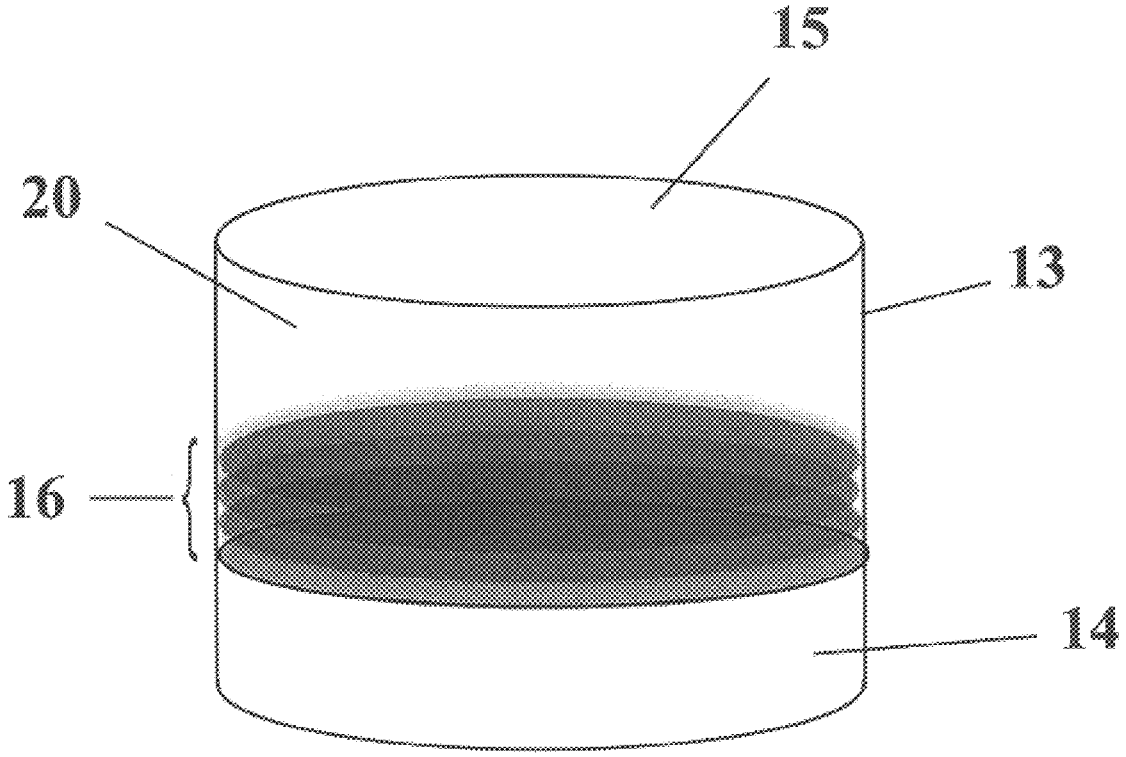
FIG. 2 shows how the heavy gases sink down to block oxygen from the liquid surface. Because the blend of gas is heavier than oxygen, gravity will separate the liquid surface from any oxygen that may remain in a container.
Figure 3:
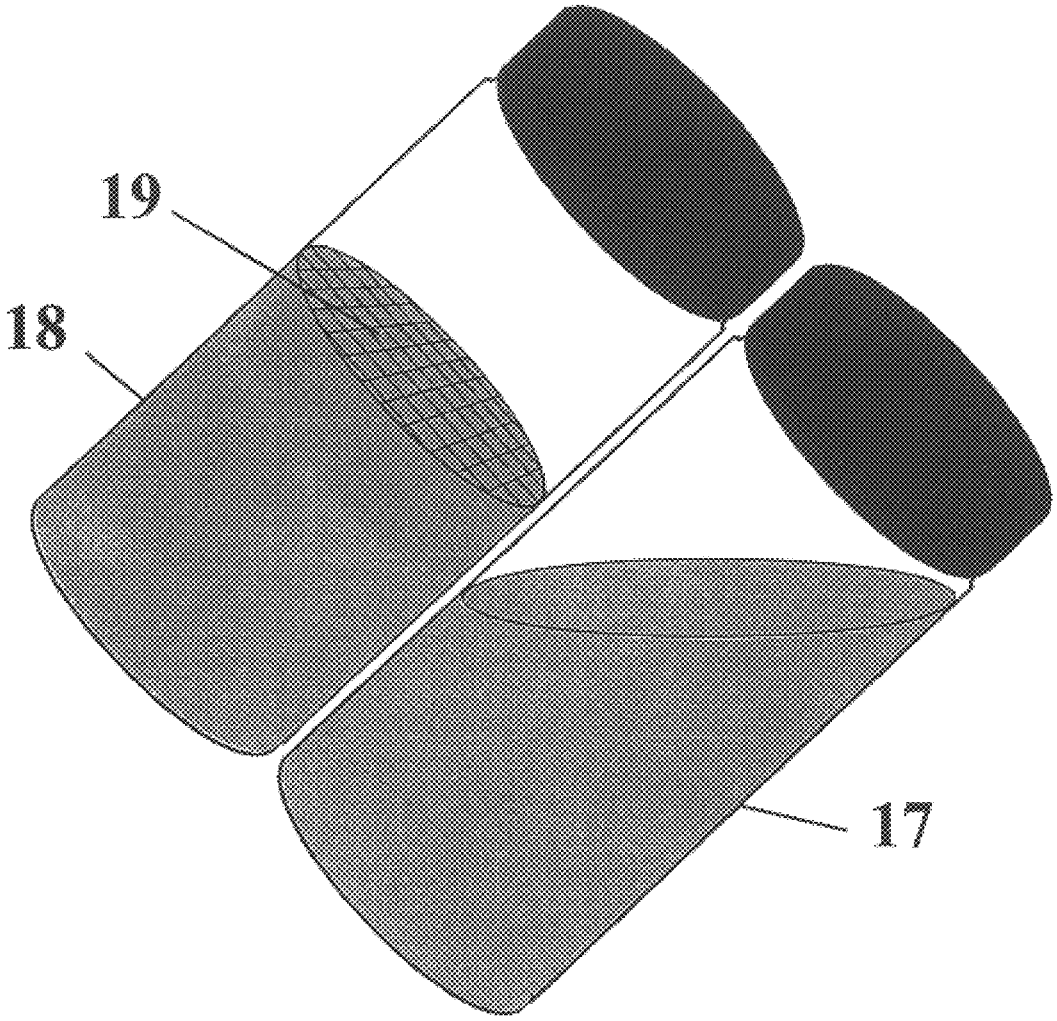
FIG. 3 shows the successful results of a preliminary test, demonstrating the protective effect of the finish preserver. The vial on the right (with the heavier gas mixture in it) has not thickened and skinned over like the vial on the left, which was unprotected prior to closure.

Reference Numerals in FIGS. 1–3:

(10) aerosol can filled with an inert gas or blend of inert gases

(12) inert gas or blend of inert gases

(13) storage container

(14) leftover liquid/oil-based finish

(15) storage container lid

(16) gases heavier than oxygen form layers of protection

(17) leftover liquid stored with blend of inert gases

(18) leftover liquid stored without blend of inert gases

(19) skinned over gel formed on top layer

(20) oxygen and lighter gases

DETAILED DESCRIPTION OF THE INVENTION

This invention relates to the method to preserve leftover products such as oil-based finish during storage and prevent such products from curing (i.e., hardening, gelling, skinning over, etc.) with oxygen. Even a tightly sealed container of leftover paint, stain, varnish, or other oil-based finish, will skin over, gel, or thicken with time. This occurs because the oxygen that is sealed in the storage container continues to react with oil-based finishes. When these finishes are stored, enough oxygen can be trapped inside the container head space to cure and thicken the product, sometimes forming a skin over the top.

By using a blanket of non-reactive, protective inert gas or blend of inert gases to purge the container, finish can be stored safely and all of it used, not just the first half. One of the following heavier than oxygen inert gases can be used in the present method: carbon dioxide, argon, xenon and krypton or a blend of such gases. In a preferred embodiment of the present invention, an effective blend of gases consists of nitrogen, argon, and carbon dioxide. The blend preferably contains an argon minimum of about 5 volume % argon and a maximum of about 40 volume %. Similarly, the blend preferably contains a carbon dioxide minimum of about 15 volume % carbon dioxide and a maximum of about 50 volume %. Therefore, the optimum blend consists of about 5 to about 40 volume % argon, about 15 to about 50 volume % carbon dioxide and the balance nitrogen. The maximum amount of nitrogen in the preferred blend is about 75% so that the resulting blend is heavier than oxygen. Although there is no minimum amount of nitrogen, it has been found that the optimum blend for the method of the present invention consists of at least 30 volume % nitrogen. Neon having a similar density to nitrogen can be also be used in the blend or substituted for nitrogen. Because nitrogen, argon and carbon dioxide each have a different density, they form three layers of protection and defense against oxygen remaining in the container.

FIG. 1 shows the process of using aerosol can 10 filled with the preferred blend of gases 12 to displace the oxygen from container 13 containing leftover finish 14 in container 13. After the oxygen 20 is flushed out of container 13 with blend 12, lid 15 is sealed tightly. A sturdy aerosol container 10 is used so the gases can be pressurized and applied in such a manner. The aerosol can 10 is typically eighteen bar aluminum material that holds approximately 160 psi pressure.

As FIG. 2 shows, the layers of heavy gases 16 sink down to block oxygen from the surface of liquid finish 14 with each of the separate gases of blend 12 providing the three layers of protection and defense from oxygen. Because the preferred blend of gases is heavier than air, it will immediately force the oxygen from container 13 and separate the liquid surface from any oxygen or lighter gases 20 that may remain in container 13. Gravity forces the lighter gases and oxygen away from the liquid and heavy gases. The leftover finish 14 will store indefinitely with the lid 15 sealed tightly.

FIG. 3 shows the results of a successful preliminary test, demonstrating the protective effect of the finish preserver method. Right vial 17 contains the heavier gas mixture in it and does not have thickened or skinned over gel 19 as left vial 18, which was unprotected prior to closure.

What is claimed is:

1. A method for preserving a petroleum-based liquid product containing atmospheric oxygen in the head space during storage comprising the steps of:

(a) displacing substantially all atmospheric oxygen from the head space of a container containing said product using an inert gas or blend of inert gases, said gas or said blend being heavier than atmospheric oxygen; and (b) dispensing inert gas or said blend of inert gases is into said container from an aerosol can; and (c) sealing said container for storage after said atmospheric oxygen has been displaced from said container with said gas or said blend.

2. The method of claim 1 wherein said inert gas is selected from the group consisting of argon, carbon dioxide, krypton, xenon and mixtures thereof.

3. The method of claim 1 wherein said container contains a leftover petroleum-based liquid product substantially cured by atmospheric oxygen.

4. The method of claim 2 wherein a blend of at least two of said inert gases sufficient to prevent said product from curing due to atmospheric oxygen is used.

5. The method of claim 4 wherein said blend also contains nitrogen, neon or mixtures thereof.

6. The method of claim 5 wherein said blend consists of nitrogen, argon and carbon dioxide.

7. The method of claim 6 wherein said blend consists of about 5 to about 40 volume % argon, about 15 to about 50 volume % carbon dioxide and the balance nitrogen.

* * * * *